US005237765A

United States Patent [19]

Vargish, II

[11] Patent Number: 5,237,765

[45] Date of Patent: Aug. 24, 1993

[54] ILLUMINATED DISPLAY SIGN

[75] Inventor: George Vargish, II, Franklin Lakes, N.J.

[73] Assignee: Vargish Industries, Franklin Lakes, N.J.

[21] Appl. No.: 747,608

[22] Filed: Aug. 20, 1991

[51] Int. Cl.[5] ..... G09F 13/26

[52] U.S. Cl. ..... 40/545

[58] Field of Search ..... 40/545, 606, 558, 552, 40/575, 541, 611; 362/812

[56] References Cited

U.S. PATENT DOCUMENTS

| | | | |
|---|---|---|---|
| 524,752 | 8/1894 | Böhm | 362/812 X |
| 2,201,093 | 5/1940 | Illo | 40/575 X |
| 2,885,538 | 5/1959 | Mahon et al. | 40/545 X |
| 3,947,985 | 4/1976 | Skrzypczak | 40/545 X |
| 4,212,003 | 7/1980 | Mishoe et al. | 40/545 X |
| 4,998,365 | 3/1991 | Bezek | 40/545 |

*Primary Examiner*—Kenneth J. Dorner
*Assistant Examiner*—J. Bonifanti
*Attorney, Agent, or Firm*—Morrison Law Firm

[57] ABSTRACT

An illuminated display includes a neon tube and a power supply with flasher mounted on a removable backboard within a transparent tube. The removability of the backboard permits changing the message on the display. The display can be secured to a wall, floor, or any other suitable display location. The display can also be mounted in a movable pedestal for portable applications. Opaque appearance materials conceal internal components of the display. Controls permit varying the color intensity and flash rate of the neon tube.

12 Claims, 4 Drawing Sheets

FIG. 2
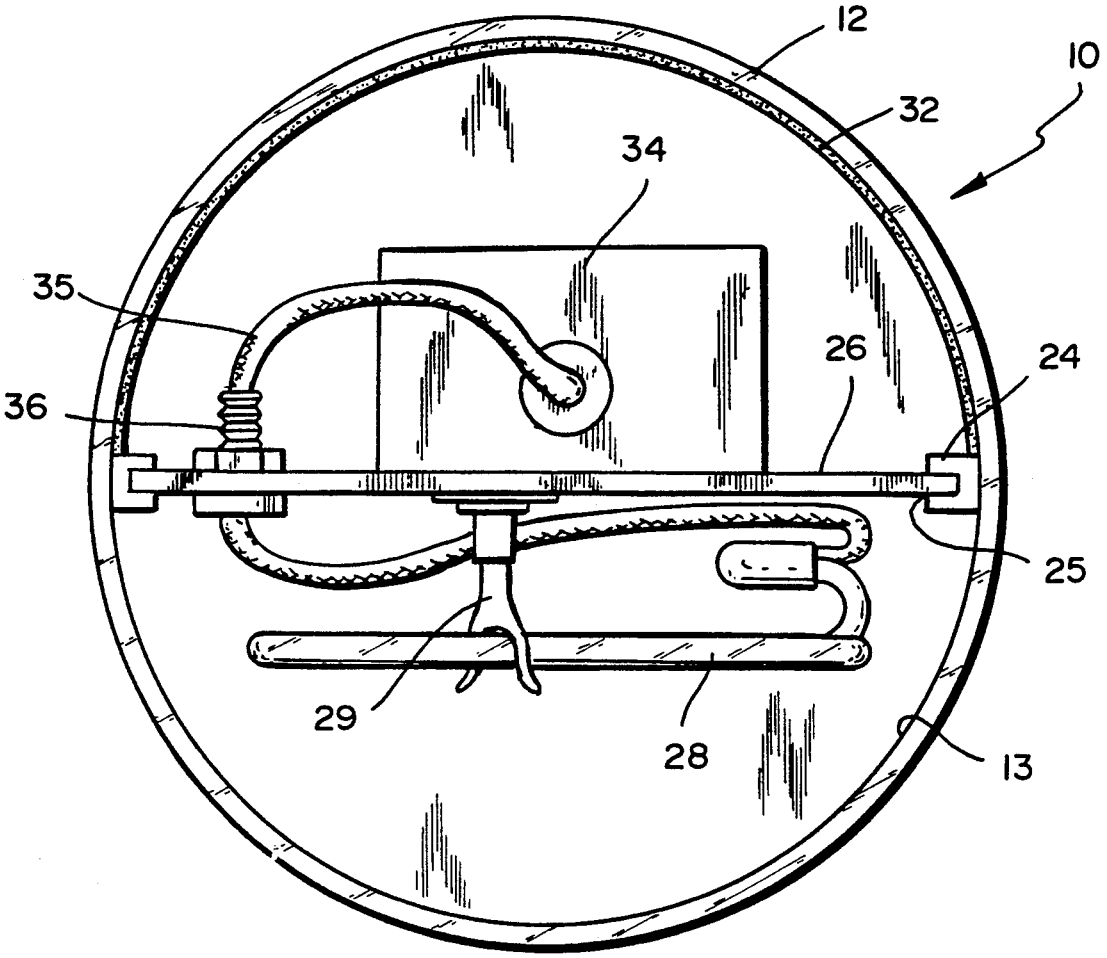
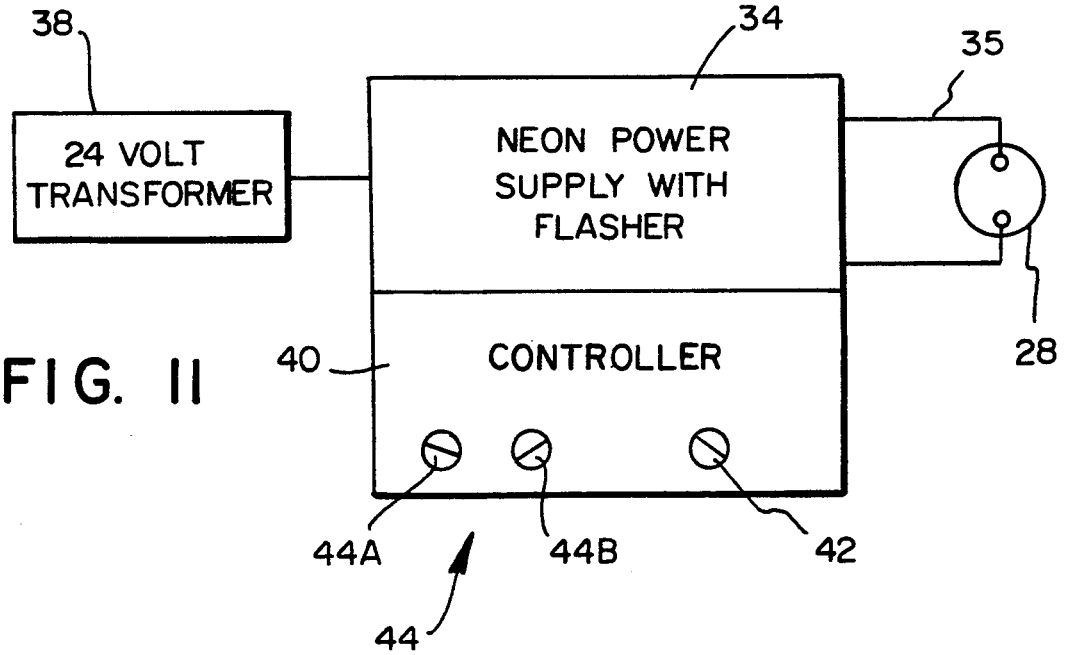
FIG. 11

ILLUMINATED DISPLAY SIGN

BACKGROUND OF THE INVENTION

The present invention relates to display signs and more particularly to freestanding neon display signs used to highlight business specialties.

The use of neon signs to announce business names or specialties is well known. Generally such neon display signs are permanently installed in prominent locations, to provide the greatest possible visibility available for a fixed installation. Apparent major disadvantages of such displays are that once installed, they do not allow for convenient changes of messages and they are not easily installed or moved. Most often, professional help is required to alter or move these displays.

OBJECTS AND SUMMARY OF THE INVENTION

It is therefore and object of the invention to provide an illuminated display sign that overcomes the drawbacks of the prior art.

It is a further object of the present invention to provide a neon illuminated display sign that provides for convenient interchange of messages as well as movability and portability.

Briefly stated, there is provided an illuminated display that includes a message spelled out with a neon tube and a power supply mounted on a removable backboard within a transparent tube. The removability of the backboard permits changing the message on the display. The display can be secured to a wall, the floor, or any other suitable display location. Opaque appearance materials conceal internal components of the display. Controls permit varying the color intensity and flash rate of the neon tube. By virtue of its size and the nature of its enclosure, it can additionally be mounted on a removable pedestal and used as a truly portable illuminated display.

According to an embodiment of the invention, there is provided an illuminated display, comprising: a transparent tube, means for supporting the transparent tube on a surface, first and second channels oppositely disposed within the transparent tube, a backboard supported in the first and second channels and dividing a portion of the transparent tube into a front part and a rear part, a neon tube message, means for mounting the neon tube on the backboard facing the front part, a neon power supply mounted on the backboard facing the rear part, means for connecting power from the power supply to the neon tube, an opaque layer covering the rear part, whereby visual access to the power supply and wiring is blocked, and the first and second channels providing means for removing the backboard, with the neon tube and the power supply, to permit replacement thereof with another backboard, neon tube and power supply, whereby a message on the neon tube may be changed.

The above, and other objects features and advantages of the present invention will become apparent from the following description read in conjunction with the accompanying drawings, in which like reference numerals designate the same elements.

BRIEF DESCRIPTION OF THE DRAWINGS

FIG. 2 is a top view of the invention of FIG. 1 with its cap removed.

FIG. 11 is a schematic diagram of the neon sign of FIG. 1.

DETAILED DESCRIPTION

Figure 1:
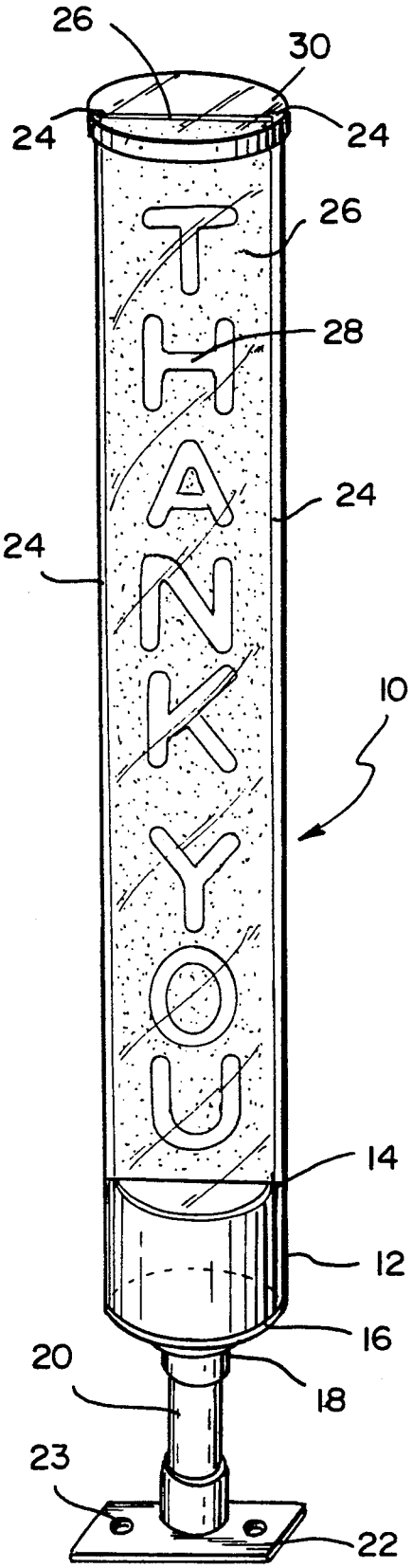
FIG. 1 is a side view of a neon sign according to an embodiment of the invention.
Figure 1A:
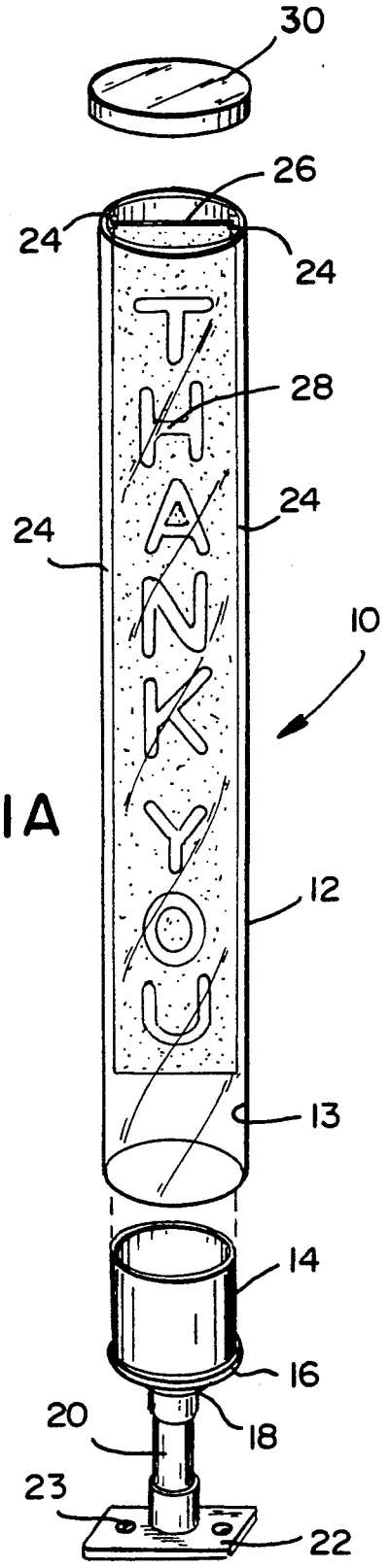
FIG. 1A is partially exploded view of the neon sign of FIG. 1.
Figure 3:
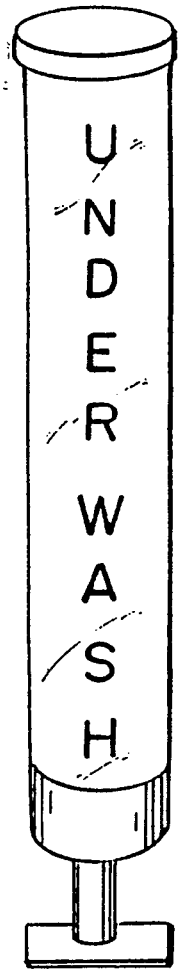
FIGS. 3 through 10 show possible messages that can be displayed by the invention.
Figure 4:
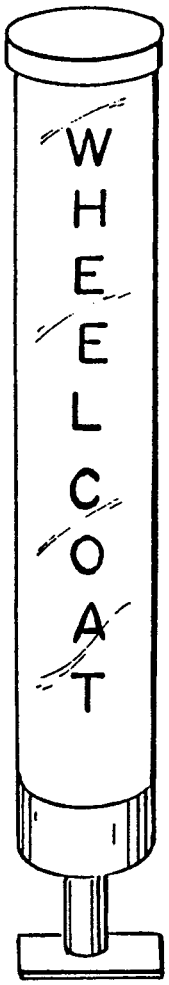
Figure 5:
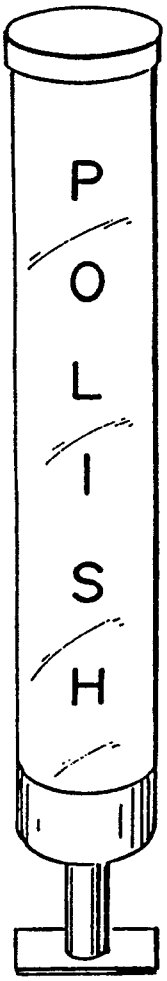
Figure 6:
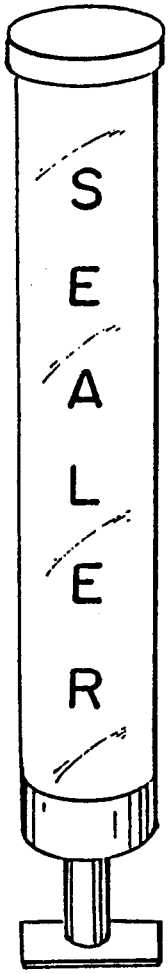
Figure 7:
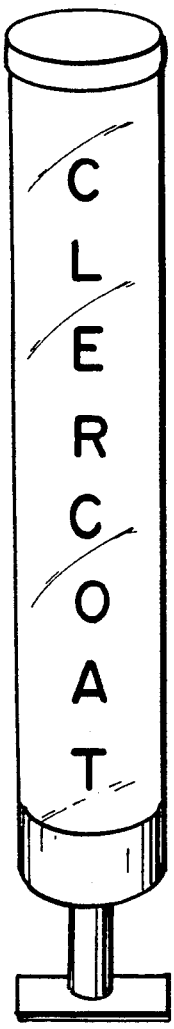
Figure 8:
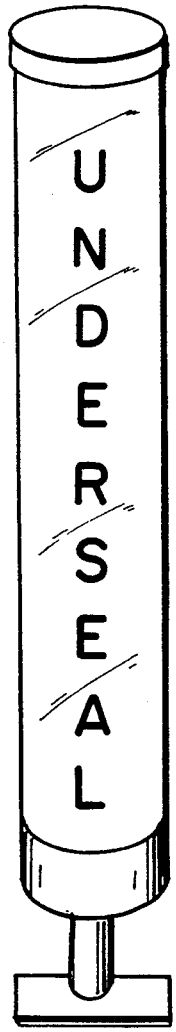
Figure 9:
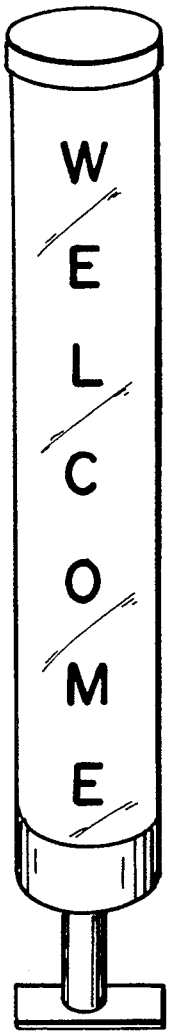
Figure 10:
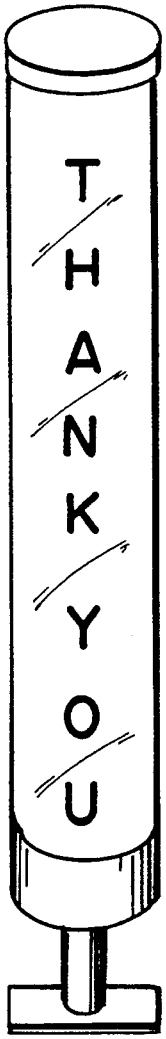

Referring to FIGS. 1 and 1A, a first end of a transparent tube 12 of an illuminated display 10, is removably fitted over a first end of a base 14. Tube 12 is an elongate cylinder that may be manufactured from any suitable transparent material such as for example, an acrylic. Base 14 is manufactured from black acrylic or the like and is sealed at a second end by a disc 16 of a like material. A flattened disc shaped end of an upper flange 18 is attached to an outer surface of disc 16. An opposite end of upper flange 18 is a cylindrical tube that is fitted over a first end of a cylindrical support pipe 20, whose second end is inserted into a cylindrical first end of mounting flange 22. A flattened rectangular second end of mounting flange 22 includes two mounting holes 23 disposed on opposite sides of the rectangular second end.

Referring now also to FIG. 2, opposing channels 24 are affixed longitudinally to diametrically opposite positions on an inner wall 13 of tube 12. Facing longitudinal slots 25 of channels 24 support a backboard 26 between them. Backboard 26, which is comprised of an opaque acrylic sheet, or the like, supports, along its length, a neon tube 28 by means of neon tube supports 29. A half cylindrical, black plastic shield 32 is inserted into tube 12 on a side of backboard 26 opposite neon tube 28 to provide an appearance screen that blocks visibility from the rear into tube 12.

A neon power supply with flasher 34 is disposed in tube 12 on backboard 26 facing shield 32. A first end of a cable 35, which passes through a bushing 36, is connected to power supply with flasher 34. A second end of cable 35 is connected to neon tube 28. A cap 30, which may be formed of vinyl, closes a second end of tube 12.

Referring to FIG. 11, a 24 volt transformer with connector plug 38 is connected to any convenient utility outlet to connect line power to power supply with flasher 34. A controller 40, on power supply with flasher 34 includes a color intensity control 42 and two flasher controls 44. Flasher control 44A is used to set the duration of the on time of neon tube 28, while flasher control 44*b* is used to set its off time. The operating power output of power supply with flasher 34 is connected by cable 35 to neon tube 28.

During operation, color intensity control 42 sets the color intensity of neon tube 28, while flash controls 44A and 44B set the flashing rate of neon tube 28. The flashing rate of neon tube 28 is settable between a steady glow and a rapidly flashing glow such as for a stroboscopic effect.

Because illuminated display 10 is a self-contained unit having simple installation requirements, it can be positioned in any convenient location to meet the needs of a user at which electrical power is available. In addition, illuminated display 10 is rotatable on base 14, so that neon tube 28 can face in any direction about the axis formed by pipe 20.

A major advantage of the invention is the simple interchangability of neon tube 28, which allows the message to be changed as product or activity specials change. To accomplish this, cap 30 is removed from tube 12 and 24 volt transformer with connector plug 38 is disconnected from the utility outlet and current backboard 26 is then slid out of slots 25 of channels 24 with neon tube 28 and power supply with flasher 34 attached. A replacement backboard having attached thereto a replacement neon tube 28 and power supply with flasher 34 is then slid into slots 25, cap 30 is replaced and 24 volt transformer with connector plug 38 is reconnected to the utility outlet.

Another advantage is the ability to rotate the display a full 360°, after illuminated display 10 is mounted, for easy visibility adjustment with out tools.

The safety of a low voltage, 24 volt, power supply is still another advantage of the invention.

FIGS. 3 through 10, illustrate possible messages that may be interchanged in illuminated display 10, when installed, for example, at a car wash.

Having described preferred embodiments of the invention with reference to the accompanying drawings, it is to be understood that the invention is not limited to those precise embodiments, and that various changes and modifications may be affected therein by one skilled in the art without departing from the scope and spirit of the invention as defined in the appended claims.

What is claimed is:

1. An illuminated display, comprising:

a transparent tube;

means for supporting said transparent tube on a surface;

first and second channels oppositely disposed within said transparent tube;

a backboard supported in said first and second channels and dividing a portion of said transparent tube into a front part and a rear part;

a neon tube;

means for mounting said neon tube on said backboard facing said front part;

a neon power supply with flasher mounted on said backboard facing said rear part;

means for connecting power from said power supply with flasher to said neon tube;

an opaque layer covering said rear part, whereby visual access to said power supply with flasher is blocked; and said first and second channels providing means for removing said backboard, with said neon tube and said power supply with flasher attached, to permit replacement thereof with another backboard, neon tube and power supply with flasher, whereby a message on said neon tube may be changed.

2. An illuminated display according to claim 1, wherein said means for supporting includes:

a base fitted into a bottom of said transparent tube;

a mounting flange connected to said base; and said mounting flange including means for permitting attachment thereof to said surface.

3. An illuminated display according to claim 2, further comprising:

a cap fitted on a top of said transparent tube; and said cap being removable for permitting said backboard, with said neon tube and power supply with flasher, to be removed and replaced through said top.

4. An illuminated display according to claim 1, further comprising means for varying a color intensity of said neon tube.

5. An illuminated display according to claim 1, further comprising means for flashing said neon tube.

6. An illuminated display according to claim 1, wherein said means for flashing is effective for flashing said neon tube at rates from steady state to stroboscopic.

7. An illuminated display according to claim 1, further comprising at least one of means for varying a color intensity of said neon tube, and a means for flashing said neon tube, is contained in said transparent tube.

8. An illuminated display according to claim 1, further comprising removable means for connecting said illuminated display to an external power source.

9. An illuminated display according to claim 1, wherein said backboard is opaque.

10. An illuminated display according to claim 1, wherein said opaque layer is a black plastic layer.

11. An illuminated display according to claim 1, wherein said transparent tube is a cylinder.

12. An illuminated display according to claim 1, wherein said transparent tube is parallelipiped.

* * * * *